United States Patent [19]

Joo

[11] Patent Number: 4,471,882

[45] Date of Patent: Sep. 18, 1984

[54] CONTAINER

[75] Inventor: Katsuhiro Joo, Tokushima, Japan

[73] Assignee: Shikoku Kakooki Co., Ltd., Tokushima, Japan

[21] Appl. No.: 443,113

[22] Filed: Nov. 19, 1982

[51] Int. Cl.[3] ..... B65D 75/00

[52] U.S. Cl. ..... 220/450; 220/353

[58] Field of Search ..... 220/67, 450, 353, 66, 220/75; 229/4.5, 5.5, 37 R, 38, 48 R, 33

[56] References Cited

U.S. PATENT DOCUMENTS

| | | | |
|---|---|---|---|
| 1,100,448 | 6/1914 | Selz | 229/4.5 X |
| 1,565,765 | 12/1925 | Walter | 229/48 R X |
| 1,967,931 | 7/1934 | Fox | 229/5.5 |
| 2,372,805 | 4/1945 | Zalkind | 229/48 R |
| 2,425,708 | 8/1947 | Wilcox | 229/5.5 |
| 2,608,340 | 8/1952 | Donnell | 229/33 |
| 3,434,644 | 3/1969 | Collie | 220/67 X |
| 3,485,436 | 12/1969 | Mirasol, Jr. | 229/5.5 X |
| 3,567,104 | 3/1971 | Arslanian | 229/5.5 X |
| 4,355,756 | 10/1982 | Furuya et al. | 229/4.5 |

*Primary Examiner*—Stephen Marcus
*Assistant Examiner*—Robert Petrik
*Attorney, Agent, or Firm*—Armstrong, Nikaido, Marmelstein & Kubovcik

[57] ABSTRACT

A container comprising a foldable tubular main body, a bottom portion made of plastic and fixedly attachable to one end of the main body and a mouth portion made of plastic and fixedly attachable to the other end of the main body. The main body consists essentially of an inner plastic layer, an intermediate metal foil and an outer layer.

1 Claim, 5 Drawing Figures

CONTAINER

BACKGROUND OF THE INVENTION

The present invention relates to a container for containing liquids for transport or storage.

Glass bottles were generally used for transporting or delivering liquids to customers, but they are costly to transport and undesirable from the viewpoint of savings in resources, so that integrally molded plastic containers and cartons are recently in wide use. However, such contains have the following drawbacks. In the case of plastic containers of relatively large capacity, the container molding machine has small ability and is uneconomical to incorporate into a high-speed filling machine. Accordingly the containers are molded and filled at different locations by a manufacturer and a dealer respectively. This gives rise to the necessity that the containers produced at one site must be transported to another site for filling. Since plastic containers are bulky although lightweight, they are inefficient and costly to transport. Furthermore containers made singly of a plastic are poor in impermeability to gas or air tightness and are not suited to the handling or preservation of liquid products over a prolonged period of time. In the case of cartons, on the other hand, a break or pinhole is likely to develop in the aluminum foil or plastic coating covering the carton blank when the blank is bent and heat-sealed. Further because cartons have low strength at the bottom, various problems arise during handling or transport.

SUMMARY OF THE INVENTION

An object of the present invention is to provide a container which is not bulky, for example, when it is transported before filling.

Another object of the invention is to provide a tough container having high air tightness.

The container of the invention comprises a foldable tubular main body, a bottom portion made of plastic and fixedly attachable to one end of the main body and a mouth portion made of plastic and fixedly attachable to the other end of the main body. The main body at least has an inner plastic layer, an intermediate metal foil and an outer layer.

Since the container of this invention comprises the above-mentioned main body, plastic bottom portion and plastic mouth portion, these components can be made separately and transported to a filling site, where the container can be fabricated from the components. Accordingly the components can be transported from the container production site to the filling site with the main body folded to a compacted form and are therefore efficient and inexpensive to transport.

Further because the main body consists essentially of an inner plastic layer, an intermediate metal foil and an outer layer, pinholes or like defects are unlikely develop in the container. The metal foil gives high air tightness to the container.

The bottom portion, which is made of plastic, has sufficient strength.

Other features of the present invention will become apparent from the following description.

DESCRIPTION OF THE PREFERRED EMBODIMENT

The container of the invention comprises a a main body 1 in the form of a tube having a quadrilateral cross section, and a bottom portion 2 and a mouth portion 3 to be secured to the opposite ends of the main body 1.

Figure 1:
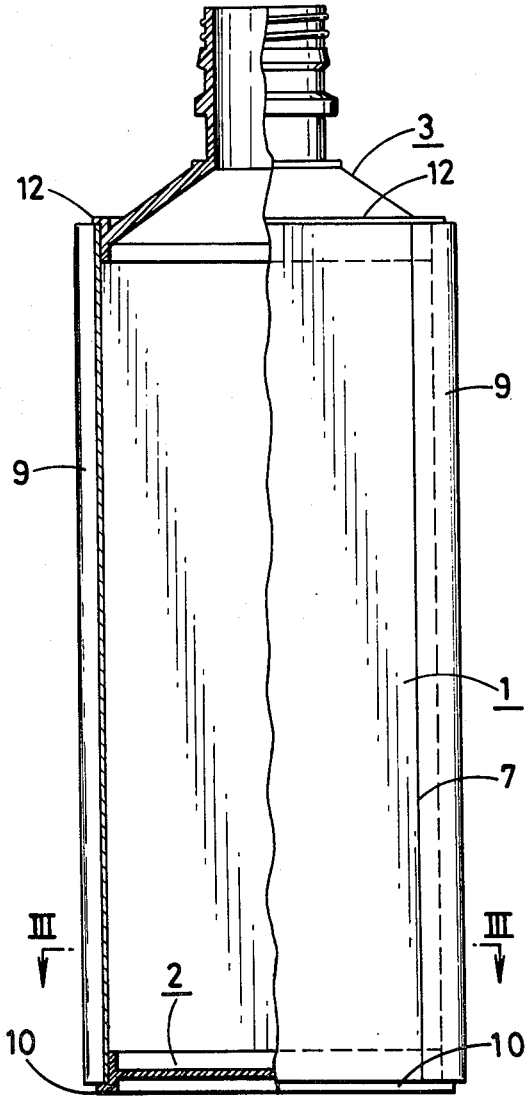
FIG. 1 is a side elevation partly broken away and showing an embodiment of the invention.
Figure 2:
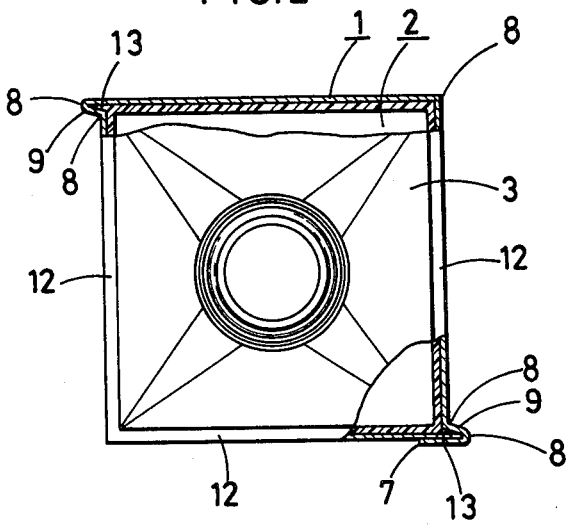
FIG. 2 is a plan view partly broken away and showing the same.
Figure 3:
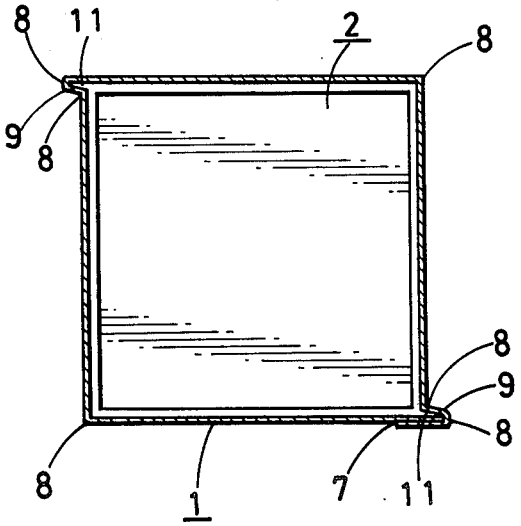
FIG. 3 is a view in section taken along the line III—III in FIG. 1.
Figure 4:
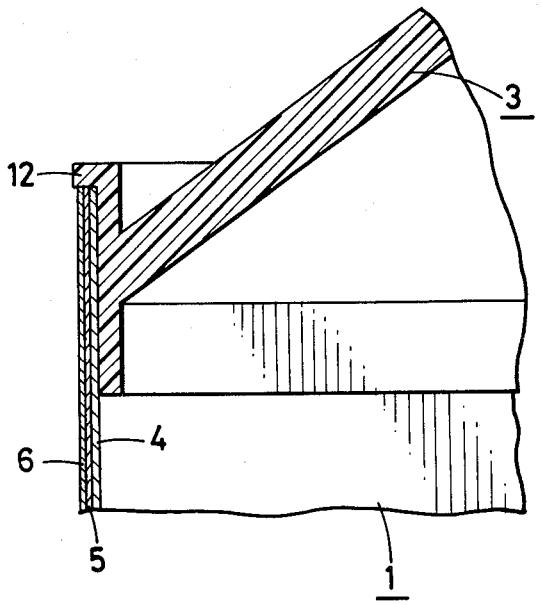
FIG. 4 is an enlarged fragmentary view of FIG. 1.
Figure 5:
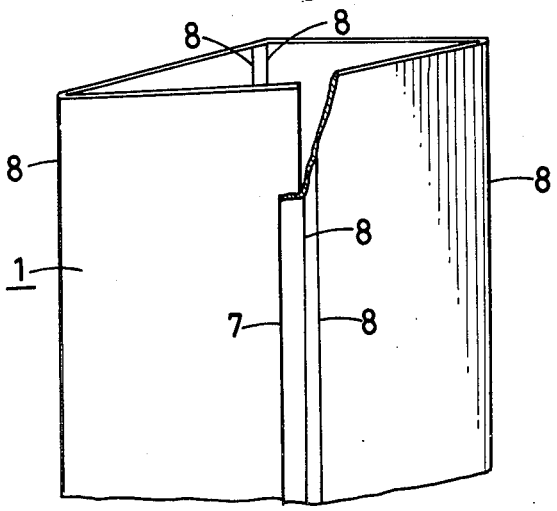
FIG. 5 is a perspective view showing a main body in a folded state.

The main body 1 is formed from a rectangular or square sheet by bending the sheet and joining the opposite ends of the sheet to each other as at 7. The main body 1 comprises three layers, i.e., an inner plastic layer 4 of polyethylene resin or the like having a thickness of about 40 to about 60 μm, an intermediate metal foil layer 5, such as aluminum foil, having a thickness of about 10 to about 20 μm, and an outer layer 6 of polyethylene terephthalate resin, paper or the like having a suitable thickness. The main body 1 is formed with six fold lines 8 parallel to the joint 7. During storage or transport before forming a container, the main body 1 is folded in two at the two fold lines 8 which are positioned symmetrically, as shown in FIG. 5. When forming the container, the main body 1 is bent at the six fold lines 8 into a square form when seen in plan. Two symmetric side edges of the main body 1 are each formed with a folded lap 9 of small width as extended from one of the two adjoining sides of the main body. The opposed inner surfaces of each folded lap 9 are joined to each other when the bottom portion 2 and the mouth portion 3 are joined to the main body as will be described below.

The bottom portion 2 is an integral molded piece of polyethylene resin or like plastic which is square when seen in plan. The bottom portion 2 is fitted into the lower end of the main body 1 from below and hermetically jointed to the inner surface of the body 1 by a suitable method such as high-frequency heat sealing. The four sides of the bottom portion 2 joined to the inner surface of the main body 1 are integrally formed with an outwardly projecting horizontal flange 10 in contact with the lower end of the main body 1. Two sides edges of the bottom portion 2 which are positioned symmetrically are each integrally formed with a thin projection 11 which is held between and joined to the opposed inner surfaces of the corresponding lap 9 of the main body 1.

The mouth portion 3 is an integral molded piece of polyethylene resin or like plastic which is square when seen from above. The lower end of the mouth portion is fitted into the upper end of the main body 1 from above and is hermetically joined to the inner surface of the main body 1 in the same manner as above. The four sides of the mouth portion 3 joined to the inner surface of the main body 1 are integrally formed with an outward horizontal flange 12 in contact with the upper extremity of the main body 1. Two side edges of the mouth portion 3 which are positioned symmetrically are each integrally formed with a thin projection 13 which is held between and joined to the opposed inner surfaces of the corresponding lap 9 of the main body 1.

The main body 1, the bottom portion 2 and the mouth portion 3 of the container are not limited to those of the foregoing embodiment in construction but can be modified suitably. The inner plastic layer 4 of the main body 1, the bottom portion 2 and the mouth portion 3 may be made of any desired material insofar as these portions can be joined to the layer. The outer layer 6 of the main body 1 may also be made of any desired material. Furthermore, the thickness of the plastic layer 4, as well as of the metal foil 5, is suitably variable. Another layer may be interposed between the plastic layer 4 and the metal foil 4, as well as between the metal foil 5 and the outer layer 6.

What is claimed is:

1. A container comprising a foldable tubular main body having a quadrilateral cross-section and being formed from a rectangular sheet by bending the sheet and joining the opposite ends of the sheet to each other, a bottom portion made of plastic fittable in and fixedly attachable to one end of said main body, and a mouth portion made of plastic fittable in and fixedly attachable to the other end of the main body; the main body at least having an inner plastic liner, an intermedate metal foil, and an outer layer, the main body being formed at least one side edge thereof with a folded lap of small width, and each of the bottom portion and the mouth portion being integrally formed at least one side edge thereof with a thin projection holdable in and joinable to the folded lap of the main body.

* * * * *